US010113817B2

(12) United States Patent
Spryshak

(10) Patent No.: US 10,113,817 B2
(45) Date of Patent: Oct. 30, 2018

(54) HEATER CORE

(71) Applicant: Valeo Climate Control Corp., Auburn Hills, MI (US)

(72) Inventor: Joseph Spryshak, Hartland, MI (US)

(73) Assignee: VALEO CLIMATE CONTROL CORP., Auburn Hills, MI (US)

( * ) Notice: Subject to any disclaimer, the term of this patent is extended or adjusted under 35 U.S.C. 154(b) by 928 days.

(21) Appl. No.: 14/502,592

(22) Filed: Sep. 30, 2014

(65) Prior Publication Data

US 2016/0091253 A1 Mar. 31, 2016

(51) Int. Cl.

| | |
|---|---|
| ***F28F 13/12*** | (2006.01) |
| ***F28F 3/02*** | (2006.01) |
| ***F28F 9/02*** | (2006.01) |
| ***F28D 9/00*** | (2006.01) |
| ***F28D 1/03*** | (2006.01) |
| *F28D 21/00* | (2006.01) |

(52) U.S. Cl.

CPC ..... *F28F 13/12* (2013.01); *F28D 1/0341* (2013.01); *F28D 9/0056* (2013.01); *F28F 3/027* (2013.01); *F28F 9/0273* (2013.01); *F28D 2021/0096* (2013.01)

(58) Field of Classification Search

CPC ..... F28D 1/0341; F28D 9/0056; F28D 7/005; F28D 2021/0096; F28F 13/12; F28F 3/027; F28F 3/0273; F28F 9/0273

USPC ..... 165/153, 176, 183; 62/525

See application file for complete search history.

(56) References Cited

U.S. PATENT DOCUMENTS

| | | | | |
|---|---|---|---|---|
| 4,274,482 | A | 6/1981 | Sonoda | |
| 4,976,310 | A * | 12/1990 | Jabs | F28D 7/06 165/145 |
| 4,977,956 | A * | 12/1990 | Aoki | F28D 1/05366 165/153 |
| 5,024,269 | A | 6/1991 | Noguchi et al. | |
| 5,042,577 | A * | 8/1991 | Suzumura | B23K 1/0012 165/153 |

(Continued)

FOREIGN PATENT DOCUMENTS

| | | |
|---|---|---|
| FR | 2873796 | 2/2006 |

OTHER PUBLICATIONS

Gilles Elliot, Heater core for motor vehicle, Feb. 3, 2006, Google translation for FR 2873796 A1.*

*Primary Examiner* — Raheena R Malik

(74) *Attorney, Agent, or Firm* — Dierker & Kavanaugh, P.C.

(57) ABSTRACT

A heater core includes a plurality of plate pairs. Each plate pair defines a respective fluid flow chamber. Each plate pair has a proximal plate defining a respective proximal plate plane and a distal plate defining a respective distal plate plane. Each of the proximal plate planes and the distal plate planes are parallel. Each plate pair has bilateral symmetry about a medial plane orthogonal to the proximal plate planes. A circular inlet aperture is defined in each respective proximal plate and each respective distal plate of the plurality of plate pairs. Each inlet aperture has a center on the medial plane. The inlet apertures are aligned on a common inlet aperture axis. A circular outlet aperture is defined in each respective proximal plate and each respective distal plate of the plurality of plate pairs. Each outlet aperture has a center on the medial plane.

15 Claims, 6 Drawing Sheets

(56) References Cited

U.S. PATENT DOCUMENTS 5,062,477 A * 11/1991 Kadle ..... B60H 1/3227 165/152
5,503,223 A * 4/1996 Choi ..... F28D 1/0341 165/153
5,513,700 A * 5/1996 Kleve ..... F28D 1/0341 165/153
5,531,268 A * 7/1996 Hoshino ..... F28D 1/0476 165/149
5,649,592 A * 7/1997 Nishishita ..... F28D 1/0341 165/153
5,653,283 A * 8/1997 Yoshii ..... F25B 39/02 165/134.1
5,669,439 A * 9/1997 Hasegawa ..... F28D 1/0341 165/153
5,810,077 A * 9/1998 Nakamura ..... F25B 39/024 165/153
6,072,153 A * 6/2000 Aoki ..... B60H 1/00828 165/202
6,216,773 B1 4/2001 Falta
6,530,423 B2 * 3/2003 Nakado ..... F28D 1/0341 165/153
7,178,585 B1 * 2/2007 Mehendale ..... F28D 1/0333 165/153
7,219,717 B2 * 5/2007 Hanafusa ..... F25B 39/022 165/153
7,343,965 B2 3/2008 Memory et al.
2002/0174978 A1 * 11/2002 Beddome ..... F28D 9/0043 165/174
2003/0116310 A1 * 6/2003 Wittmann ..... F28D 1/0341 165/153
2003/0159807 A1 * 8/2003 Ayres ..... F28D 9/0043 165/81
2004/0003916 A1 * 1/2004 Nash ..... F28D 9/0043 165/153
2004/0026072 A1 * 2/2004 Yi ..... F28D 1/0341 165/175
2005/0205245 A1 * 9/2005 Beatenbough ..... F28D 1/0341 165/152
2005/0279485 A1 * 12/2005 Chiba ..... F28D 1/0333 165/78
2006/0236538 A1 * 10/2006 Nakagawa ..... B23K 1/203 29/890.03
2007/0261832 A1 * 11/2007 Ware ..... F28D 9/005 165/167
2008/0110595 A1 * 5/2008 Palanchon ..... F28D 9/0043 165/103
2008/0223565 A1 * 9/2008 Lai ..... F28F 9/0273 165/174
2010/0193169 A1 * 8/2010 Yamada ..... F28D 9/005 165/167
2010/0300667 A1 * 12/2010 Samuelson ..... F28D 1/05383 165/175
2010/0313587 A1 * 12/2010 Wolfe, IV ..... B60H 1/005 62/244
2011/0127023 A1 * 6/2011 Taras ..... F28F 9/0273 165/173
2011/0203780 A1 * 8/2011 Jiang ..... F28D 1/05366 165/173
2012/0272679 A1 * 11/2012 Vreeland ..... B60H 1/005 62/524
2013/0133866 A1 * 5/2013 Kinder ..... F28D 9/0056 165/151
2014/0238641 A1 * 8/2014 Gerges ..... F02M 26/32 165/76
2015/0052893 A1 * 2/2015 Geskes ..... F28D 7/0025 60/618
2016/0018169 A1 * 1/2016 Powell ..... F28F 13/06 165/109.1

* cited by examiner

HEATER CORE

BACKGROUND

A heater core is a heat exchanger that transfers heat from engine coolant to flowing air in a heating ventilation and air conditioning (HVAC) unit of an automobile. Liquid engine coolant is pumped through coolant paths in an internal combustion engine to carry waste heat from the engine and keep the engine within operational temperature limits. A heater core may be installed in the coolant path and in an airflow path within the HVAC unit. A fan may blow air through the heater core that has been warmed by the engine coolant. As the air passes through the heater core, the engine waste heat is transferred from the liquid engine coolant to the air, thereby raising the temperature of the air. The heated air is ducted to the passenger compartment of the vehicle to raise the temperature of the air in the passenger compartment.

SUMMARY

A heater core includes a plurality of plate pairs. Each plate pair defines a respective fluid flow chamber. Each plate pair has a proximal plate defining a respective proximal plate plane and a distal plate defining a respective distal plate plane. Each of the proximal plate planes and the distal plate planes are parallel. Each plate pair has bilateral symmetry about a medial plane orthogonal to the proximal plate planes. A circular inlet aperture is defined in each respective proximal plate and each respective distal plate of the plurality of plate pairs. Each inlet aperture has a center on the medial plane. A circular outlet aperture is defined in each respective proximal plate and each respective distal plate of the plurality of plate pairs. Each outlet aperture has a center on the medial plane. The inlet apertures are aligned on a common inlet aperture axis.

BRIEF DESCRIPTION OF THE DRAWINGS

Features and advantages of examples of the present disclosure will become apparent by reference to the following detailed description and drawings, in which like reference numerals correspond to the same or similar, though perhaps not identical, components. For the sake of brevity, reference numerals or features having a previously described function may or may not be described in connection with other drawings in which they appear.

DETAILED DESCRIPTION

Some existing heater cores are heat exchangers having opposed end tanks and tubes connecting the end tanks with fins between the tubes. Coolant flows from an inlet tank through the tubes to an outlet tank. Air is warmed (and the coolant is cooled) as the air is blown over the tubes and fins. Another type of existing heat exchanger is a stacked plate heat exchanger. In an example of an existing stacked plate heat exchanger, aligned pairs of stamped plates form integral headers and flow tubes. Each plate of each aligned pair is rectangular, and has an inner surface that faces the inner surface of the other plate. The two plates are sealed together by brazing to create a thin, wide flow tube between the inner surfaces of the plates. Cups are stamped at the ends of the plates (e.g. one cup at each end, or two cups at one end). The cups protrude away from the outer surface of the plates and are open to the inner surface of the plates. When the plate pairs (flow tubes) are stacked together to assemble the generally box shaped heat exchanger, the pairs of oppositely protruding cups align to create header pipes, either one pipe on each side of the heat exchanger or two adjacent pipes on one side. The stacked cups of the aligned plate pairs also act to space out the plate pairs to provide space for corrugated air cooling fins.

Figure 1:
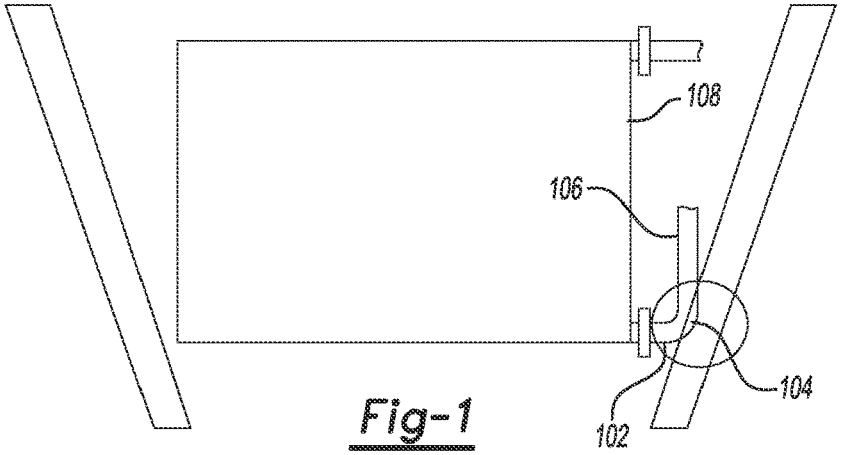
Fig-1 PRIOR ART
FIG. 1 is a semi-schematic rear view of an existing heater core with interference to the HVAC unit.
Figure 2A:
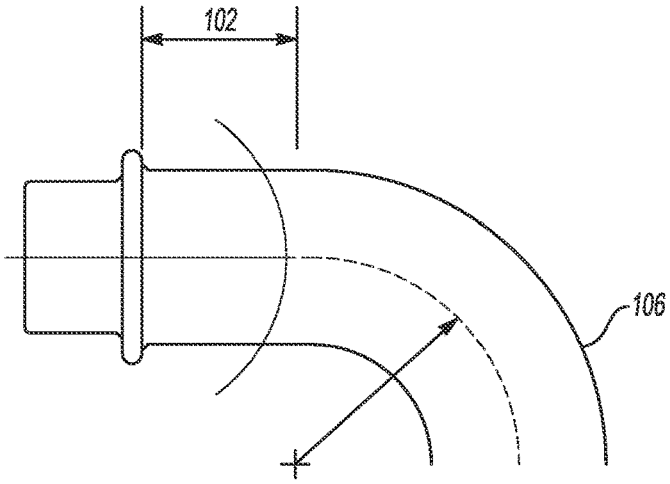
Fig-2A PRIOR ART
FIG. 2A is a semi-schematic view of an existing bent inlet line with a straight portion to accommodate a tubing bender.

The package space available in an HVAC unit in a vehicle may be narrowest at the corners of the heater core. In some existing heater cores that have the coolant inlet tubes and outlet tubes at a corner of the heater core, providing space for the coolant inlet tubes and outlet tubes reduces the space available for the stacked plates. In some existing heater cores, with bent inlet and outlet tubes, a straight portion 102 is required between the bent portion 104 and the interface between the inlet line 106 and the end plate 108 (e.g., see FIG. 1). The straight portion 102 is required for the tooling used to make the bend in the inlet line 106 (see FIG. 2A). The straight portion increases the clearance required for the inlet line 106 and further reduces the space available for the stacked plates. Similar clearance may be required for the outlet tube in existing heater cores (not shown).

Examples of the present disclosure use more of the available space for the active heat exchange surface area of the heater core. The increased active heat exchange surface area may reduce the air side pressure drop and improve the power (rate of heat transfer) of the HVAC unit. Further, examples of the heater core of the present disclosure may have manufacturing and cost advantages that will be pointed out in the discussion below.

Referring now to FIGS. 3-8, examples of a heater core of the present disclosure is depicted in various semi-schematic views. An example of the heater core 10 includes a plurality of brazed plate pairs 12. Each brazed plate pair 12 defines a respective fluid flow chamber 14. Each brazed plate pair 12 has a proximal plate 16 defining a respective proximal plate plane 18 and a distal plate 20 defining a respective distal plate plane 22. Each of the proximal plate planes 18 and the distal plate planes 22 are parallel. Each brazed plate pair 12 has bilateral symmetry about a medial plane 24 orthogonal to the proximal plate planes 18. Since the distal plate planes 22 are parallel to the proximal plate planes 18, the medial plane 24 is also orthogonal to the distal plate planes 22.

In the example depicted in FIGS. 3-8, a circular inlet aperture 26 is defined in each respective proximal plate 16 and each respective distal plate 20 of the plurality of brazed plate pairs 12. Each inlet aperture 26 has an inlet center 28 on the medial plane 24. A circular outlet aperture 27 is defined in each respective proximal plate 16 and each respective distal plate 20 of the plurality of brazed plate pairs 12. Each outlet aperture 27 has an outlet center 29 on the medial plane 24. The inlet apertures 26 are aligned on a common inlet aperture axis 30. The outlet apertures 27 are aligned on a common outlet aperture axis 31.

Figure 2B:
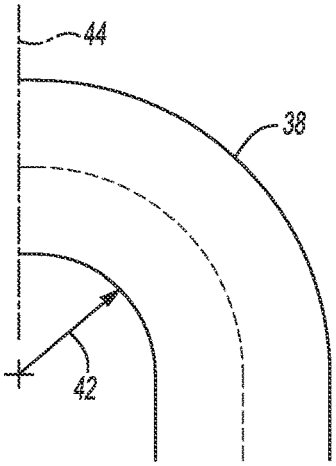
FIG. 2B is a semi-schematic view of an example of a curved inlet manifold portion of the present disclosure.

As depicted in FIGS. 3-8, the heater core 10 may include a tubular inlet manifold 32 having a linear inlet manifold portion 34 with an inlet manifold axis 36 disposed through each of the inlet apertures 26. The inlet manifold 32 may have a curved inlet manifold portion 38 with a bend 40 formed with a radius of curvature 42 centered on an end proximal plate plane 44 (FIG. 2B). As depicted, the bend 40 is a 90 degree bend; however, other bend angles are contemplated in the present disclosure. By embedding the linear inlet manifold portion 34 in the brazed plate pairs 12, the heater core 10 of the present disclosure overcomes the need for additional packaging space to accommodate the tooling for the tubing bender as discussed above regarding the existing heater core and FIGS. 1 and 2A. The inlet manifold 32 may have a single cylindrical inlet tube 46 having inlet slots 48 defined therein. The inlet manifold 32 may define an inlet manifold chamber 50 in fluid communication with each fluid flow chamber 14 via the respective inlet slot 48. Each of the inlet slots 48 may be sized independently from the other inlet slots 48, thereby allowing tuning of individual flow to each of the brazed plate pairs 12 to optimize performance. It is to be understood that the single cylindrical inlet tube 46 spans all of the brazed plate pairs 12. This is in sharp contrast to existing stacked plate heat exchangers having a header formed from a plurality of tubes and cups stacked and brazed together. The single cylindrical inlet tube 46 may cause better alignment of the brazed plate pairs 12 and more strength and durability of the brazed heater core 10. The independently sizable inlet slots 48 and the tunable flow to each of the brazed plate pairs 12 further differentiates the present disclosure from existing stacked plate heat exchangers.

Figure 2C:
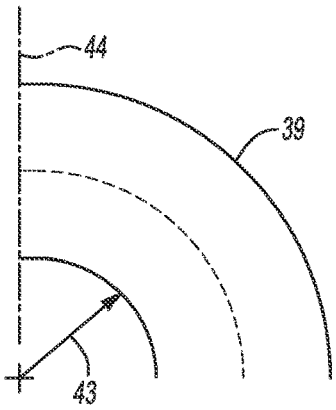
FIG. 2C is a semi-schematic view of an example of a curved outlet manifold portion of the present disclosure.

Examples of the heater core 10 may include a tubular outlet manifold 33 having a linear outlet manifold portion 35 with an outlet manifold axis 37 disposed through each of the outlet apertures 27. The outlet manifold 33 may have a curved outlet manifold portion 39 with another bend 41 formed with another radius of curvature 43 centered on the end proximal plate plane 44. (See FIG. 2C.) As depicted, the bend 41 is a 90 degree bend. However, it is to be understood that other bend angles are contemplated in the present disclosure. The outlet manifold 33 may include a single cylindrical outlet tube 47 having outlet slots 49 defined therein. The outlet manifold 33 may define an outlet manifold chamber 51 in fluid communication with each fluid flow chamber 14 via the respective outlet slot 49. Each of the outlet slots 49 may be sized independently from the other outlet slots 49, thereby (in conjunction with the tunable inlet slots 48) allowing tuning of individual flow to each of the brazed plate pairs 12 to optimize performance.

Similarly to the single inlet tube 46, it is to be understood that the single cylindrical outlet tube 47 spans all of the brazed plate pairs 12. This is in sharp contrast to existing stacked plate heat exchangers having a header formed from a plurality of tubes and cups stacked and brazed together. The single cylindrical outlet tube 47 may cause better alignment of the brazed plate pairs 12 and more strength and durability of the brazed heater core 10. The independently sizable outlet slots 49 and the tunable flow to each of the brazed plate pairs 12 further differentiate the present disclosure from existing stacked plate heat exchangers.

In examples of the heater core 10 of the present disclosure, a first edge 62 of each of the brazed plate pairs 12 lies in a first plane 64 to define a first face 66 of the heater core 10. A second edge 63 of each of the brazed plate pairs 12 opposite the first edge 62 includes a protuberance 68 to surround a portion of a perimeter 70 of the outlet aperture 27 in the brazed plate pair 12. The protuberances 68 are aligned to define a mound 74 on a second face 76 of the heater core 10 opposite the first face 66.

Figure 4:
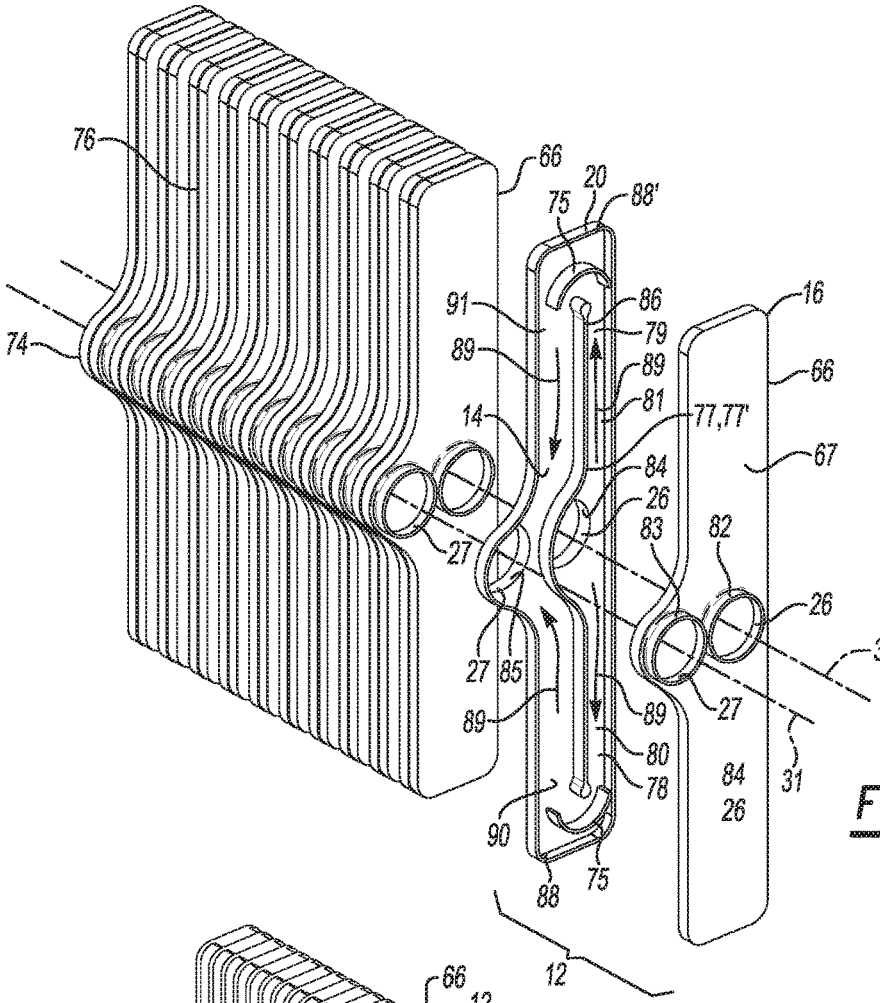
FIG. 4 is a semi-schematic rear perspective view of an example of a stack of brazed plate pairs with an exploded view of a brazed plate pair according to an example of the present disclosure.
Figure 5:
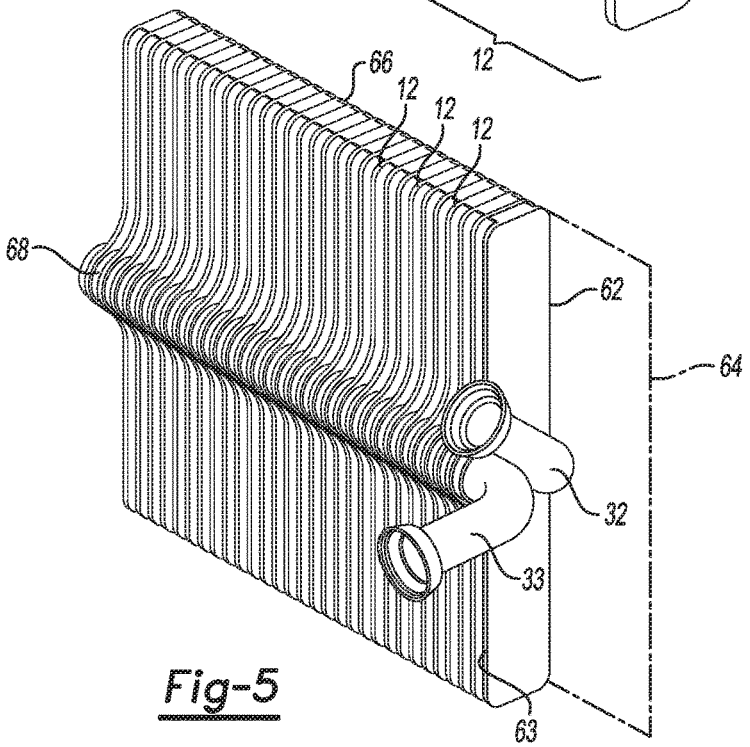
FIG. 5 is a semi-schematic rear perspective view of an example of a heater core of the present disclosure.

In the example of the heater core depicted in FIG. 4, each brazed plate pair 12 is to receive a fluid to flow from the inlet manifold 32 into the fluid flow chamber 14. The fluid flow chamber 14 has a first flow circuit 78 and a second flow circuit 79 symmetrically opposite the first flow circuit 78. Each plate pair 12 includes a septum 86 to divide the first flow circuit 78 into a first outward channel 80 leading away from the medial plane 24 to a first extremity 88 of the fluid flow chamber 14, and a first return channel 90 leading from the first extremity 88 of the fluid flow chamber 14 to the medial plane 24 and the outlet manifold 33 wherein the septum 86 is to divide the second flow circuit into a second outward channel leading away from the medial plane 24 to a second extremity 88' of the fluid flow chamber 14, and a second return channel 91 leading from the second extremity 88' of the fluid flow chamber 14 to the medial plane 24 and the outlet manifold 33. In FIG. 4, the direction of flow is indicated by the flow arrows 89. The septum 86 may be defined by mating surfaces 77, 77' of the proximal plate 16 and the distal plate 20 joined together (e.g., by brazing). Each brazed plate pair 12 may include a curved flowpath guide 75 defined at each of the extremities 88, 88' of the fluid flow chambers 14.

Figure 9:
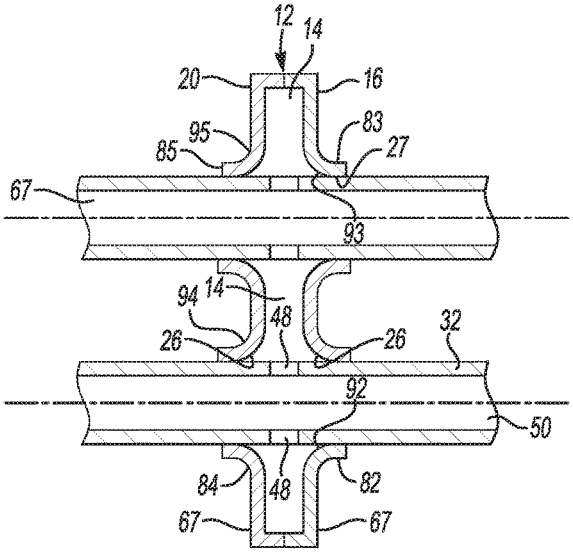
FIG. 9 is a semi-schematic cross-section view through a brazed plate pair of an example of a heater core of the present disclosure taken through the medial plane.

FIG. 9 depicts the collars 82, 83, 84, 85 surrounding the inlet apertures 26 and the outlet apertures 27. Each proximal plate 16 has a proximal inlet collar 82 defining the inlet aperture 26. The proximal inlet collar 82 defines a proximal inlet surface of revolution 92 coaxial to the inlet manifold 32. The proximal inlet collar 82 is convex to the fluid flow chamber 14 of the corresponding brazed plate pair 12.

Similarly, each proximal plate 16 has a proximal outlet collar 83 defining the outlet aperture 27. The proximal outlet collar 83 defines a proximal outlet surface of revolution 93 coaxial to the outlet manifold 33. The proximal outlet collar 83 is convex to the fluid flow chamber 14 of the corresponding brazed plate pair 12.

Also similarly, each distal plate 20 has a distal inlet collar 84 defining the inlet aperture 26. The distal inlet collar 84 defines a distal inlet surface of revolution 94 coaxial to the inlet manifold 32. The distal inlet collar 84 is convex to the fluid flow chamber 14 of the corresponding brazed plate pair 12.

Similarly, each distal plate 20 has a distal outlet collar 85 defining the outlet aperture 27. The distal outlet collar 85 defines a distal outlet surface of revolution 95 coaxial to the outlet manifold 33. The distal outlet collar 85 is convex to the fluid flow chamber 14 of the corresponding brazed plate pair 12. As depicted in FIG. 9, the collars 82 and 83 may be integrally formed with each proximal plate 16, and the collars 84 and 85 may be integrally formed with each distal plate 20.

In the example of the heater core 10 as depicted in FIG. 4, the proximal plates 16 and the distal plates 20 are identical components. Each distal plate 20 is rotated 180 degrees relative to a corresponding proximal plate 16 to be brazed together to form the brazed plate pairs 12. Since there is bilateral symmetry, structural features (e.g., inlet apertures 26 and outlet apertures 27) on the proximal plates 16 and the distal plates 20 will align. In other examples, the proximal plates 16 and the distal plates 20 may have differences that facilitate the nesting of the proximal plates 16 with the distal plates 20 prior to brazing. The proximal plates 16 and the distal plates 20 may include features that prevent improper selection or assembly. For example, the collars 82, 83, 84, 85 around the inlet aperture 26 and outlet aperture 27 protrude beyond the exterior surface 67 of the brazed plate pairs 12. If a proximal plate 16 or distal plate 20 is placed backward in the stack, the absence of a detectable collar 82, 83, 84, 85 protruding beyond the exterior surface 67 may trigger an alarm or otherwise present an opportunity to take remedial action before scrap is generated.

Figure 10A:
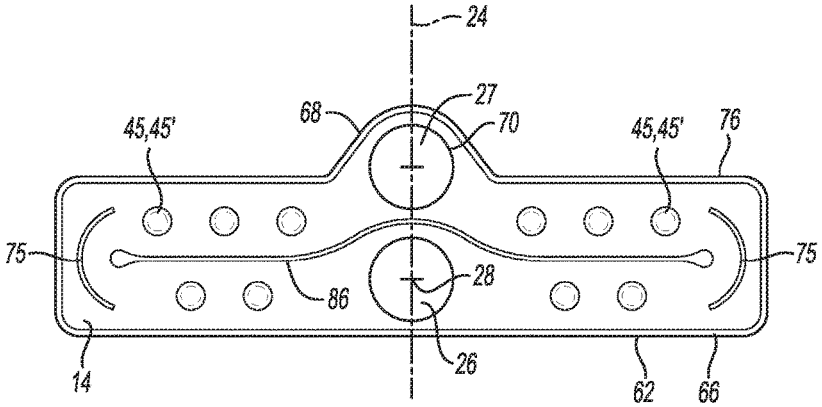
FIG. 10A is a semi-schematic cross-section view through a brazed plate pair of an example of a heater core of the present disclosure taken between a proximal plate and a distal plate.
Figure 10B:
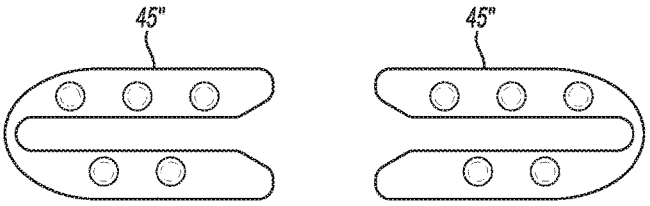
FIG. 10B is a semi-schematic left view of a turbulator insert according to the present disclosure.

As depicted in FIG. 10A, a plurality of turbulators 45 may be disposed in the fluid flow chambers 14 to induce turbulent fluid flow in a fluid flowing through the fluid flow chambers 14. In an example, the turbulators 45 may be bumps 45' or ridges formed in the proximal plates 16 or distal plates 20 to protrude into the fluid flow chambers 14. In another example, the turbulators 45 may be a turbulator insert 45" (FIG. 10B) that originates as a separate part from the proximal plate 16 and distal plate 20 to be inserted therein disposed in the fluid flow chambers 14.

Figure 3:
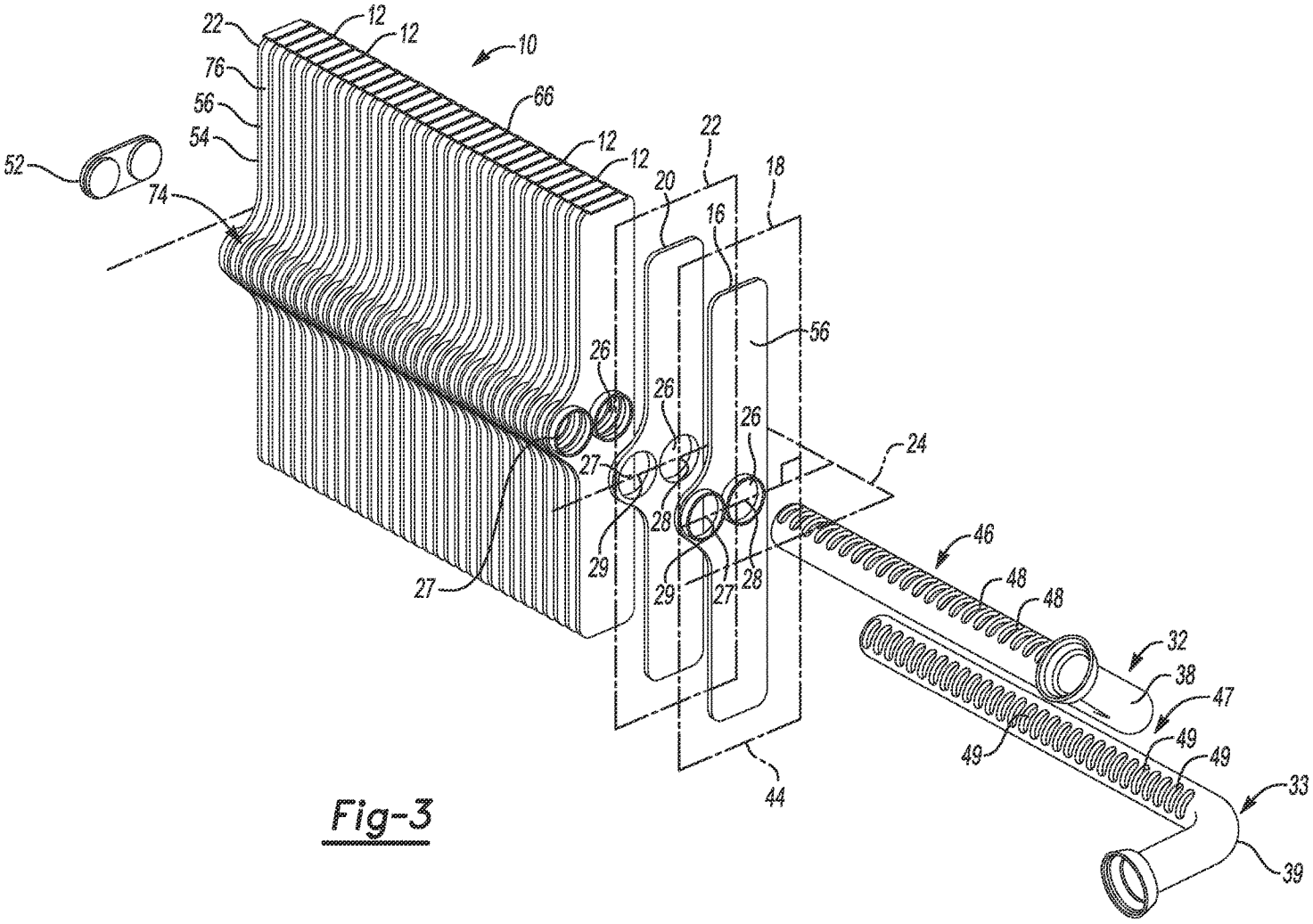
FIG. 3 is a semi-schematic rear perspective exploded view of an example of a heater core of the present disclosure.

As depicted in FIG. 3, an end cap 52 to seal the inlet aperture 26 and the outlet aperture 27 of the end distal plate 20 is disposed at the distal end 54 of the heater core 10. The end distal plate 20 is an instance of the distal plate 20 disposed at the distal end 54 of the heater core 10. In other words, the same part may be used for the end distal plate 20 as the other distal plates 20 in the heater core. As used herein, the distal end 54 of the heater core 10 is the end of the heater core that is farthest from the curved inlet manifold portion 38 and the curved outlet manifold portion 39. Further, as used herein, an end 56 of the heater core 10 means an outermost portion of the heater core 10 defined by a proximal plate plane 18 or a distal plate plane 22. Alternatively, the end caps 52 may be integral with an end distal plate 20" disposed at the distal end 54 of the heater core 10, making the end distal plate 20" unique from the other distal plates 20. The end distal plate 20" may be the same part as the distal plates 20 except the end cap 52 is integrally formed with the distal plate 20 to form the end distal plate 20".

Figure 6:
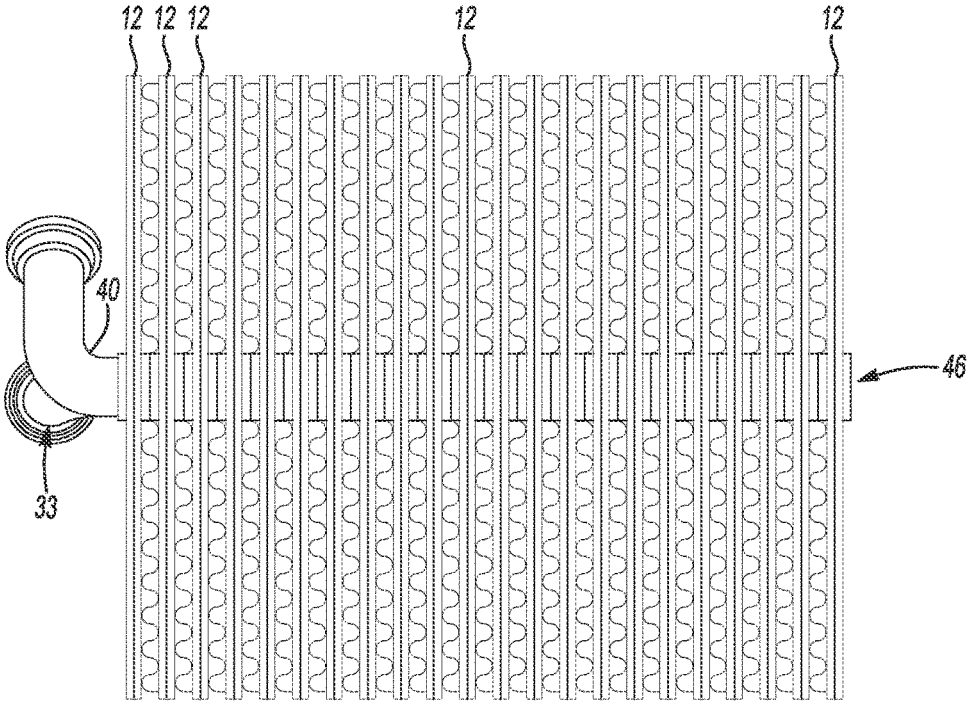
FIG. 6 is a semi-schematic front view of an example of a heater core of the present disclosure.
Figure 7:
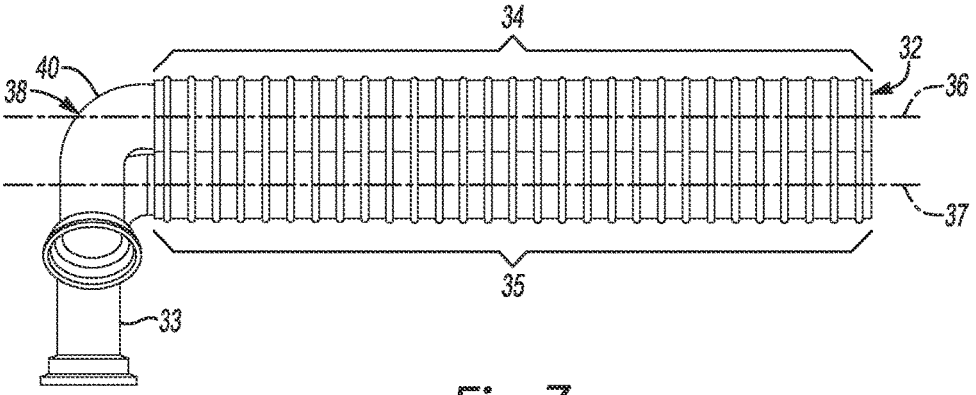
FIG. 7 is a semi-schematic top view of an example of a heater core of the present disclosure.
Figure 8:
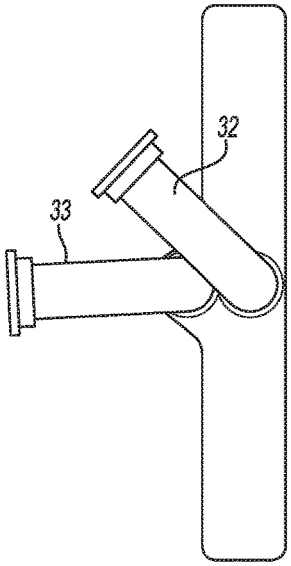
FIG. 8 is a semi-schematic left view of an example of a heater core of the present disclosure.
Figure 11A:
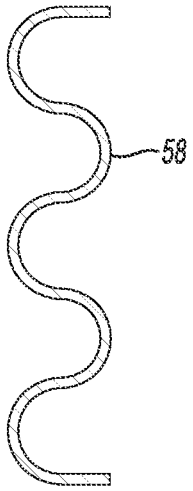
FIGS. 11A-11D are semi-schematic front views of examples of fin corrugation patterns according to the present disclosure.
Figure 11B:
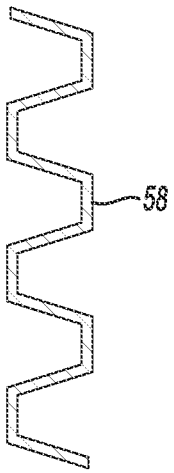
Figure 11C:
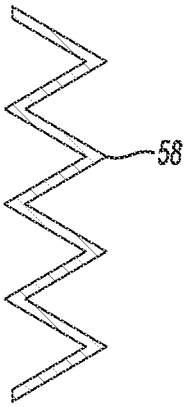
Figure 11D:
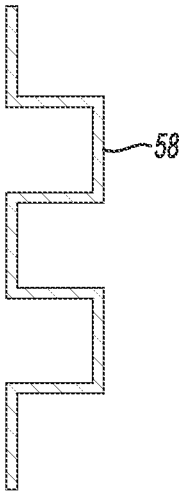

Referring to FIG. 6, examples of the heater core 10 of the present disclosure may include a plurality of fins 58 interleaved between the brazed plate pairs 12 to define air flow paths between the brazed plate pairs 12 to channel a flow of air. The fins 58 may enhance the rate of heat transfer from the heater core 10 to the air by conducting heat from the brazed plate pairs 12 to a larger surface area in contact with the air flowing over the fins. The plurality of fins 58 may include a sheet of metal having a corrugated form as depicted in FIG. 11A. The undulating pattern of corrugation may have any suitable form. Non-limiting examples of suitable forms of corrugation are: rounded as shown in FIG. 11A; trapezoidal as shown in FIG. 11B; sawtooth as shown in FIG. 11C; or square tooth as shown in FIG. 11D. The plurality of fins 58 may include louvers 60 to induce turbulence in air flowing through the fins 58.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

The terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in communication with the other component (notwithstanding the presence of one or more additional components therebetween). Additionally, two components may be permanently, semi-permanently, or releasably engaged with and/or connected to one another.

It is to be further understood that "communication" is to be construed to include all forms of communication, including direct and indirect communication. Indirect communication may include communication between two components with additional component(s) located therebetween.

While several examples have been described in detail, it will be apparent to those skilled in the art that the disclosed examples may be modified. Therefore, the foregoing description is to be considered non-limiting.

What is claimed is:

1. A heater core, comprising:

a plurality of plate pairs, each plate pair defining a respective fluid flow chamber;

each plate pair having a proximal plate defining a respective proximal plate plane and a distal plate defining a respective distal plate plane wherein each of the proximal plate planes and the distal plate planes are parallel, and each plate pair has bilateral symmetry about a medial plane orthogonal to the proximal plate planes;

a circular inlet aperture defined in each respective proximal plate and each respective distal plate of the plurality of plate pairs, each inlet aperture having an inlet center on the medial plane, the inlet apertures aligned on a common inlet aperture axis; and a circular outlet aperture defined in each respective proximal plate and each respective distal plate of the plurality of plate pairs, each outlet aperture having an outlet center on the medial plane, wherein:

a first edge of each of the plate pairs lies in a first plane to define a first face of the heater core;

a second edge of each of the plate pairs opposite the first edge includes a protuberance to surround a portion of a perimeter of the outlet aperture in the plate pair; and the protuberances are aligned to define a mound on a second face of the heater core opposite the first face.

2. The heater core as defined in claim 1 wherein the proximal plates and the distal plates are identical components, and each distal plate is rotated 180 degrees relative to a corresponding proximal plate to be joined together to form the plate pairs.

3. The heater core as defined in claim 1, further comprising a plurality of turbulators disposed in the fluid flow chambers to induce turbulent fluid flow in a fluid flowing through the fluid flow chambers.

4. The heater core as defined in claim 1, further comprising:

a tubular inlet manifold having a linear inlet manifold portion with an inlet manifold axis disposed through each of the inlet apertures, the inlet manifold having a curved inlet manifold portion with a bend formed with a radius of curvature centered on an end proximal plate plane, and a single cylindrical inlet tube having inlet slots defined therein wherein the inlet manifold defines an inlet manifold chamber in fluid communication with each fluid flow chamber via the respective inlet slot; and a tubular outlet manifold having a linear outlet manifold portion with an outlet manifold axis disposed through each of the outlet apertures, the outlet manifold having a curved outlet manifold portion with an other bend formed with an other radius of curvature centered on the end proximal plate plane, and a single cylindrical outlet tube having outlet slots defined therein wherein the outlet manifold defines an outlet manifold chamber in fluid communication with each fluid flow chamber via the respective outlet slot.

5. The heater core as defined in claim 4 wherein:

the distal plate disposed at a distal end of the heater core is an end distal plate;

the distal end of the heater core is the end of the heater core farthest from the curved inlet manifold portion; and an end cap is to seal the inlet aperture and the outlet aperture of the end distal plate.

6. The heater core as defined in claim 4, further comprising an end cap to seal the inlet aperture and the outlet aperture of an end distal plate disposed at a distal end of the heater core, wherein the distal end of the heater core is the end of the heater core farthest from the curved inlet manifold portion, and wherein the end cap is integral with the end distal plate.

7. The heater core as defined in claim 4, further comprising a plurality of fins interleaved between the plate pairs to define flow paths between the plate pairs for air to flow therethrough.

8. The heater core as defined in claim 7 wherein each of the plurality of fins includes a sheet of metal having a corrugated form.

9. The heater core as defined in claim 7 wherein each of the plurality of fins includes louvers to induce turbulence in air flowing through the fins.

10. The heater core as defined in claim 4 wherein:

each proximal plate has a proximal inlet collar defining the inlet aperture;

the proximal inlet collar defines a proximal inlet surface of revolution coaxial to the inlet manifold;

the proximal inlet collar is convex to the fluid flow chamber of the corresponding plate pair;

each proximal plate has a proximal outlet collar defining the outlet aperture;

the proximal outlet collar defines a proximal outlet surface of revolution coaxial to the outlet manifold;

the proximal outlet collar is convex to the fluid flow chamber of the corresponding plate pair;

each distal plate has a distal inlet collar defining the inlet aperture;

the distal inlet collar defines a distal inlet surface of revolution coaxial to the inlet manifold;

the distal inlet collar is convex to the fluid flow chamber of the corresponding plate pair;

each distal plate has a distal outlet collar defining the outlet aperture;

the distal outlet collar defines a distal outlet surface of revolution coaxial to the outlet manifold; and the distal outlet collar is convex to the fluid flow chamber of the corresponding plate pair.

11. The heater core as defined in claim 4 wherein:

each plate pair is to receive a fluid to flow from the inlet manifold into the fluid flow chamber;

the fluid flow chamber has a first flow circuit and a second flow circuit symmetrically opposite the first flow circuit; and each plate pair includes a septum to divide the first flow circuit into a first outward channel leading away from the medial plane to a first extremity of the fluid flow chamber, and a first return channel leading from the first extremity of the fluid flow chamber to the medial plane and the outlet manifold wherein the septum is to divide the second flow circuit into a second outward channel leading away from the medial plane to a second extremity of the fluid flow chamber, and a second return channel leading from the second extremity of the fluid flow chamber to the medial plane and the outlet manifold.

12. The heater core as defined in claim 11 wherein the septum is defined by mating surfaces of the proximal plate and the distal plate joined together.

13. The heater core as defined in claim 11 wherein each plate pair includes a respective curved flowpath guide defined at the first extremity and the second extremity of the fluid flow chamber.

14. A heater core, comprising:

a plurality of plate pairs, each plate pair defining a respective fluid flow chamber;

each plate pair having a proximal plate defining a respective proximal plate plane and a distal plate defining a respective distal plate plane wherein each of the proximal plate planes and the distal plate planes are parallel;

a circular inlet aperture defined in each respective proximal plate and each respective distal plate of the plurality of plate pairs, the inlet apertures aligned on a common inlet aperture axis;

a circular outlet aperture defined in each respective proximal plate and each respective distal plate of the plurality of plate pairs, each outlet aperture having an outlet center on a medial plane, the outlet apertures aligned on a common outlet aperture axis;

a tubular inlet manifold having a linear inlet manifold portion with an inlet manifold axis disposed through each of the inlet apertures, the inlet manifold having a single cylindrical inlet tube having inlet slots defined therein wherein the inlet manifold defines an inlet manifold chamber in fluid communication with each fluid flow chamber via the respective inlet slot;

a tubular outlet manifold having a linear outlet manifold portion with an outlet manifold axis disposed through each of the outlet apertures, the outlet manifold having a single cylindrical outlet tube having outlet slots defined therein wherein the outlet manifold defines an outlet manifold chamber in fluid communication with each fluid flow chamber via the respective outlet slot;

a first edge of each of the plate pairs lying in a first plane to define a first face of the heater core; and a second edge of each of the plate pairs opposite the first edge including a protuberance to surround a portion of a perimeter of the outlet aperture in the plate pair wherein the protuberances are aligned to define a mound on a second face of the heater core opposite the first face.

15. The heater core as defined in claim 14 wherein each of the inlet slots is sized independently from each other inlet slot, to tune an individual flow to each of the plurality of plate pairs, and wherein each of the outlet slots is sized independently from each other outlet slot, to further tune the individual flow to each of the plurality of plate pairs.

* * * * *